US007445495B2

(12) United States Patent
Takashita

(10) Patent No.: US 7,445,495 B2
(45) Date of Patent: Nov. 4, 2008

(54) FLAT CIRCUIT BOARD ELECTRICAL CONNECTOR

(75) Inventor: Yoshinori Takashita, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/706,278

(22) Filed: Feb. 15, 2007

(65) Prior Publication Data

US 2007/0202736 A1 Aug. 30, 2007

(30) Foreign Application Priority Data

Feb. 27, 2006 (JP) ..... 2006-050081

(51) Int. Cl.
*H01R 12/24* (2006.01)

(52) U.S. Cl. ..... 439/495; 439/636

(58) Field of Classification Search ..... 439/67, 439/260, 492, 495, 496, 387, 441, 636, 637
See application file for complete search history.

(56) References Cited

U.S. PATENT DOCUMENTS 5,498,169 A * 3/1996 Ikemoto ..... 439/260
5,785,549 A * 7/1998 Takayasu ..... 439/495
5,904,589 A * 5/1999 Asakawa ..... 439/495
6,641,431 B2 * 11/2003 Saitoh ..... 439/495
7,083,454 B2 * 8/2006 Suzuki ..... 439/260
7,086,884 B2 * 8/2006 Okano ..... 439/260
7,094,093 B2 * 8/2006 Nakano et al. ..... 439/495
7,147,498 B1 * 12/2006 Gillespie et al. ..... 439/260
2004/0110412 A1 * 6/2004 Ueda ..... 439/495
2006/0178039 A1 * 8/2006 Chen ..... 439/495

FOREIGN PATENT DOCUMENTS

JP 3047862 3/2000

* cited by examiner

*Primary Examiner*—Thanh-Tam T Le
(74) *Attorney, Agent, or Firm*—Kubotera & Associates, LLC

(57) ABSTRACT

An electrical connector includes a housing (1) and a plurality of terminals (10) having parallel upper and lower arms (11, 12) that have projections (11A, 12A) between which a flat circuit board (F) is inserted for electrical connection to the terminals (10). The projection (12A) of the lower arm (12) has a sharp point.

19 Claims, 5 Drawing Sheets

FLAT CIRCUIT BOARD ELECTRICAL CONNECTOR

BACKGROUND OF THE INVENTION

1. Field of the Invention

The present invention relates to electrical connectors for a flat circuit board.

2. Description of the Related Art

The conventional flat circuit boards include flexible printed circuit boards (FPC) and flat cables. Japanese Patent No. 3047862 discloses a connector for connecting such a flat circuit board to a member to be connected such as another circuit board.

As FIG. 6 shows, in the connector of the above Patent, a terminal 60 supported by a housing 50 is made by stamping a metal sheet so as to have a pair of parallel arms 61 and 62 and a linking section 63 that links these arms at the middle position. The arms 61 and 62 have contact projections 64 and 65 at one end and, at the other end, a flexible section to be flexed by a rotary member 70 and a connection section 66 to be connected to a circuit board, respectively. The rotary member 70 is supported by the arm 62 at a circular projection 71 for rotation. When it is rotated in the A direction, its pressure section 72 pushes up the free end of the arm 61.

After a flat circuit board F is inserted into a space between the contact sections 64 and 65 of the arms 61 and 62, the rotary member 70 is rotated in the A direction to flex upward the free end of the arm 61. Consequently, the contact section 64 is moved downward to hold the flat circuit board F between the contact sections 64 and 65 such that the circuit section F1 is connected electrically to the circuit board via the terminal 60.

The contact sections 64 and 65 of the above connector have a rounded tip so as to prevent scratching the flat circuit board F. However, the rounded tips can permit the flat circuit board F to come off by accidental pull. The flat circuit board has the circuit section F1 on the front side and a reinforcing film of polyamide or the like on the back side for easy insertion. Scratching the reinforced side does not matter.

SUMMARY OF THE INVENTION

Accordingly, it is an object of the invention to provide a flat circuit board electrical connector capable of preventing accidental separation of the flat circuit board by making use of the back side on which no circuit is provided.

According to the invention, a flat circuit board electrical connector includes a housing and a plurality of flat terminals supported by the housing and having parallel upper and lower arms with projections between which a flat circuit board is inserted such that the flat circuit board is connected to the terminals, wherein the projection of at least one of the arms has a sharp tip. The sharp tip of the projection cuts into the flat circuit board on the reinforced plate or area that has no circuit section.

Most of the flat circuit boards have a circuit section on one surface and no circuit section but a reinforcing plate on the other surface. Even if a circuit section is present, some flat circuit boards have an area that has no circuit around the circuit section. The sharp tip of a terminal cuts into such an area as having no circuit section or the reinforcing plate, thus preventing separation of the flat circuit board.

In the flat circuit board electrical connector, the sharp tip may be made by front and rear edges, the front edge making an acute angle with the flat circuit board on a side of the rear edge, thus maximizing the gripping power. The projection of one of the arms may have a rounded tip while the projection of the other arm has a sharp tip, thus maximizing both the contact pressure and the gripping power.

At least one projection on one of the arms may have a sharp tip and the other projections have rounded tips. The projections on upper and lower arms may be situated at the same positions as viewed from an insertion direction of the flat circuit board, thus assuring both the contact pressure and the gripping power.

At least one of the projections may have a plurality of sharp tips provided in the insertion direction of a flat circuit board, thus assuring prevention of separation of the flat circuit board. In addition, the stress on one of the sharp tips is reduced so that the damage made by the sharp tips is reduced. Moreover, even if the position of the projection of an arm is displaced from that of the other arm in the insertion direction, the projection of the one arm may cooperate with that of the other arm.

According to the invention, the projection of a terminal is provided with a sharp tip that cuts into the reinforcing film or plate of a flat circuit board, or the area on which no circuit section is provided, thus assuring prevention of separation of the flat circuit board.

DESCRIPTION OF THE PREFERRED EMBODIMENT

Figure 1:
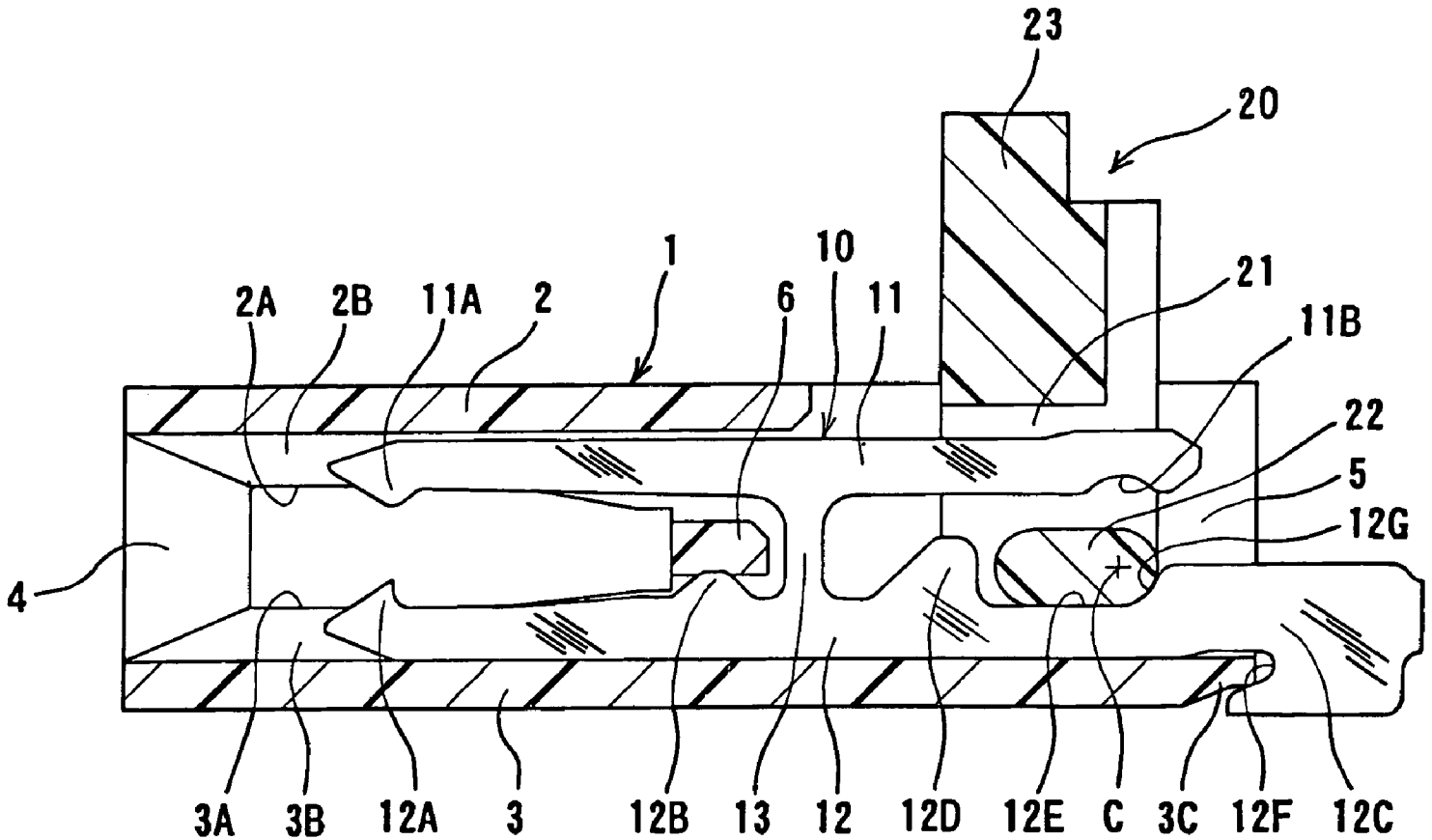
FIG. 1 is a sectional view of a connector, with a pressure member at the open position, according to an embodiment of the invention.

In FIG. 1, a housing 1 is made of an insulative material so as to have a substantially rectangular form as a whole. A terminal 10, which is supported by the housing 1, is made by stamping a metal sheet. The housing 1 has upper and lower walls 2 and 3 that are linked by side walls on opposite sides, providing a first or front opening 4 for receiving a flat circuit board and a second or rear opening 5 for receiving the terminal 10 and a portion of a pressure member 20.

A plurality of terminal retention walls 2A and 3A are provided on the insides of the upper and lower walls 2 and 3. The front sides of the terminal retention walls 2A and 3A are tapered to facilitate the insertion of a flat circuit board. A plurality of grooves 2B and 3B are made by the terminal retention walls 2A and 3A to support the terminal 10. An engaging island 6 is provided at the center of the housing 1.

Figure 2:
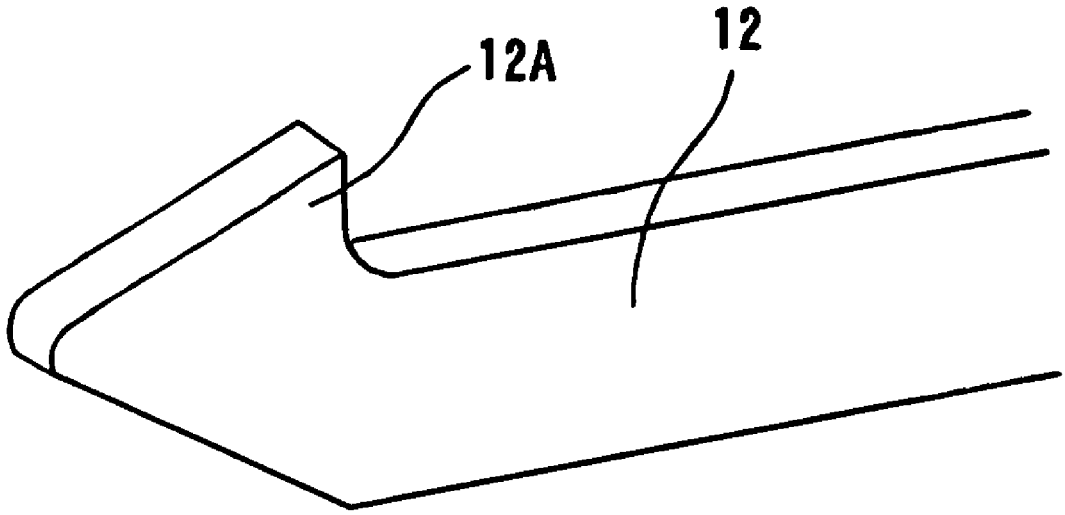
FIG. 2 is a perspective view of a sharp projection of a terminal for the connector.

A thinner section 3C is provided on rear end of the lower wall 3. The terminal 10 is stamped from a metal sheet so as to have a substantially H-shaped form that has a pair of upper and lower arms 11 and 12 and a linking section 13 to link these arms at the middle position. The front sections of the upper and lower arms 11 and 12 are placed in the grooves 2B and 3B of the upper and lower walls 2 and 3, respectively, such that the projections 11A and 12A project from the grooves 2B and 3B. The upper projection 11A has a rounded tip while the lower projection 12A has a sharp saw-tooth tip. As shown in FIG. 2, the edge of the saw-tooth tip extends linearly in the thicknesswise direction. An engaging projection 12B is provided on the lower arm 12 near the linking section 13. When the terminal 10 is inserted into the housing 1 from back, the lower arm 12 is put through a gap between the lower wall 3 and the engaging wall 6 such that the engaging projection 12B cuts into the engaging wall 6 to prevent coming off or separation of the terminal 10.

The upper arm 11 extends to almost the end of the second opening 5 and has a downward recess 11B in its lower edge. The downward recess 11B cooperates with a rounded portion 12G of the lower arm 12 to rotatably support the pressure member 20 at or near the closed position. A rotation supporting recess 12E is provided in the lower arm 12 between the connection section 12C and the protruded section 12D. The rotation supporting recess 12E has at its right side end the rounded portion 12G having a radius substantially equal to that of the downward recess 11B of the upper arm 11, a slightly rounded corner at the left side end, and a straight edge between them. The length of the rotation supporting recess 12E is made greater than the distance between the rotation supporting recess 12E and the downward recess 11B.

The connection section 12C projects from the housing 1 and extends downwardly to the lower surface of the lower wall 3 of the housing 1 and has an attaching recess 12F in its left side edge. When the terminal 10 is attached to the housing 1, the thinner portion 3C of the lower wall 3 is press fitted into the attaching recess 12F. The pressure member 20 is made of an insulative material so as to have a plate-shaped form and extends across the arrangement range of terminals 10.

As shown in FIG. 1, the pressure member 20 has a plurality of slits 21 for receiving terminals 10 and a shaft portion 22 that runs through the slits 21. The shaft portion 22 has an elongated circular cross-section and placed in the rotation supporting section 12E. The right side semi-circular portion of the shaft portion 22 has a radius substantially equal to that of the rounded portion 12G of the rotation supporting section 12E so that the pressure member 20 is rotatable about the center C of the semi-circular portion. The upper portion of the pressure member 20 in FIG. 1 projects upwardly from the housing 1, forming an operational section 23.

Figure 3:
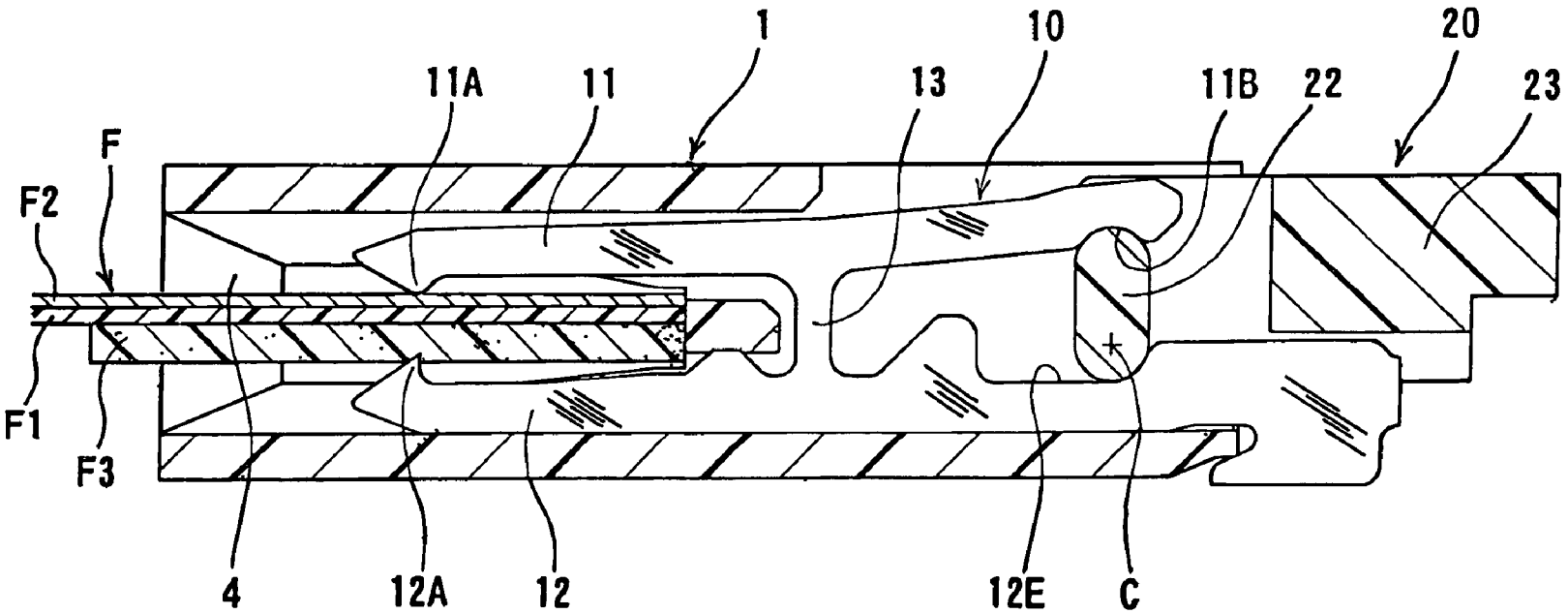
FIG. 3 is a sectional view of the connector, with the pressure member at the closed position.

As shown in FIG. 3, the flat board F has a base layer F1 made of an insulative material so as to be flexible, a circuit section F2 made of a metal layer, and a reinforcing film or plate F3 provided on the back side of a front portion that is to be inserted into the connector. The connector according to the invention is assembled and used as follows.

(1) A plurality of terminals 10 are inserted into the housing 1 through the second opening 5 such that the upper and lower arms 11 and 12 are received in the grooves 2B and 3B, respectively. The engaging projections 12B cut into the engaging walls 6 to keep the terminals 10 in place. Then, the pressure member 20 is assembled with the terminals 10 by putting the shaft portion 22 into the rotation supporting recess 12E through a space between the upper and lower arms 11 and 12.

(2) The connector is attached to a circuit board (not shown), before or after assembling the pressure member 20, by soldering the connection sections 12C of the terminals 10 to the corresponding circuit section of the circuit board.

(3) Then, the flat circuit board F is inserted into the first opening 4, with the pressure member 20 standing upright at the open position as shown in FIG. 1. When the flat circuit board F is inserted to a predetermined position, the contact projections 11A of the upper arms 11 and the sharp tip equipped projections 12A of the lower arms 11 and 12 are brought into light contact with the circuit section F2 and the reinforcing plate F3, respectively.

(4) As shown in FIG. 3, when the pressure member 20 is turned clockwise to the closed position, the major width of the shaft portion 22 stands upright. The major width of the shaft portion 22 is greater than the distance between the downward recess 11B and the rotation supporting recess 12E, the right portion of the upper arm 11 is flexed up by the shaft portion 22, flexing down the left portion of the upper arm 11. Thus, the contact projection 11A depresses the flat circuit board F against the sharp projection 12A. As a result, the sharp projection 12A cuts into the reinforcing plate F3 of the flat circuit board F. In this way, the flat circuit board F not only is brought into firm contact with the contact projections 11A but also is resistant to accidental separation.

The applicability of the present invention is not limited to the above illustrated embodiment.

Figure 4:
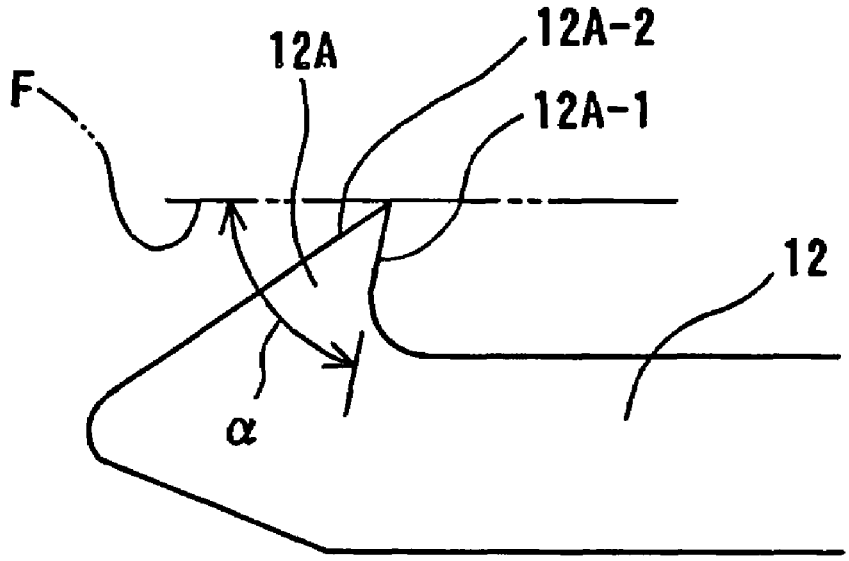
FIG. 4 is a side view of a sharp projection of a terminal according to the second embodiment.

As shown in FIG. 4, the angle a between the flat circuit board F and the front edge 12A-1 on the side of the rear edge 12A-2 is made less than 90 degrees, thus maximizing the resistant force against accidental separation of the flat circuit board.

Figure 5:
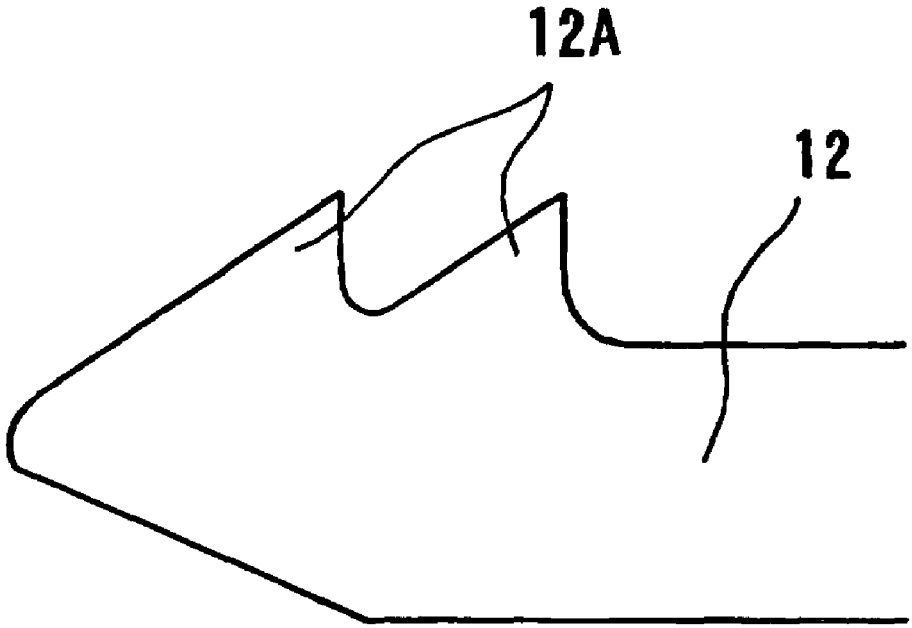
FIG. 5 is a side view of a plurality of sharp projections according to the third embodiment.
Figure 6:
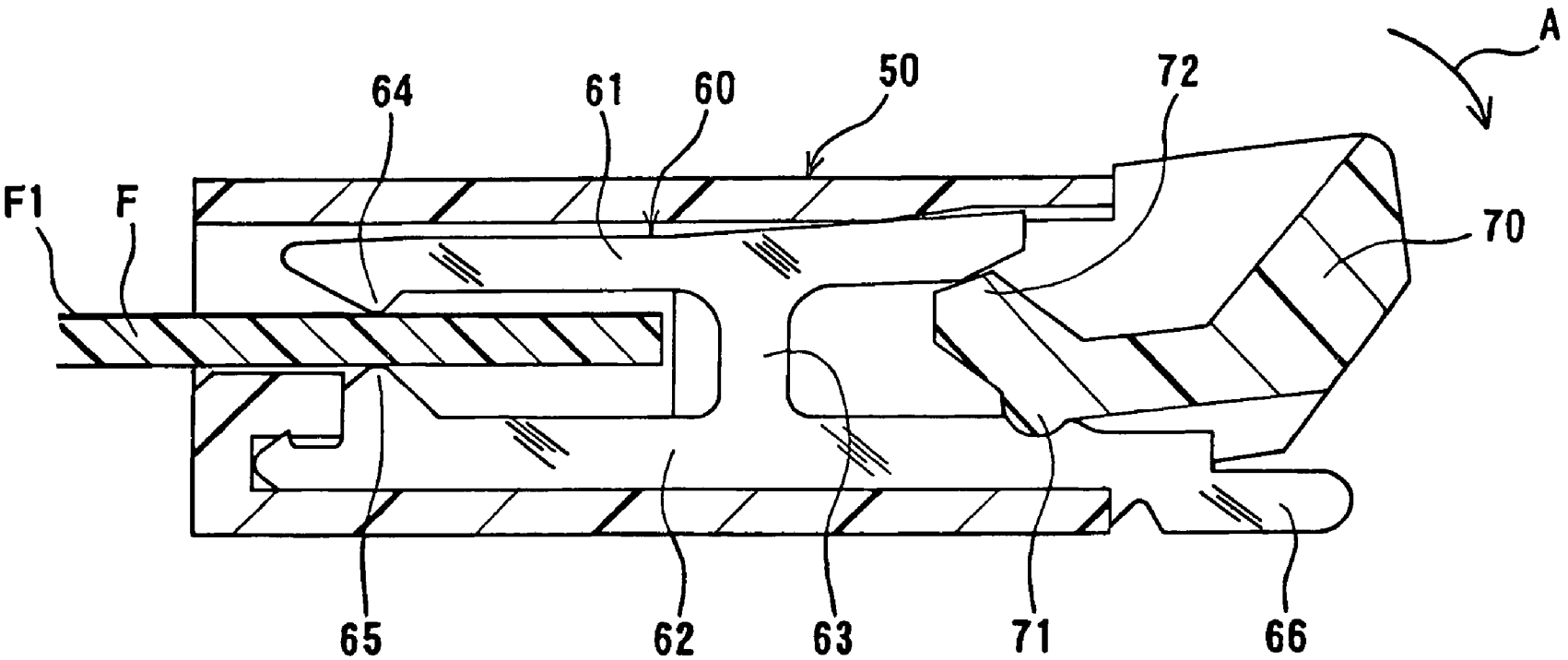
FIG. 6 PRIOR ART
FIG. 6 is a sectional view of a conventional connector.

As shown in FIG. 5, a plurality of sharp projections are provided to spread the resistance force to the plural projections, thus minimize scratches on the flat circuit board made by the sharp projections.

The sharp projections are made very sharp by stamping the front and rear edges in separate steps of the process. It is not necessary for all terminals to have a sharp projection. That is, only a sufficient number of terminals to provide the necessary resistance may be provided with sharp projections and the other terminals may be provided with rounded projections. Both upper and lower arms may be provided with a sharp projection by selecting such terminals that the sharp projections are situated at areas on which no circuit sections exist. It is preferred that the projections on the upper and lower arms be situated at the same positions in the insertion direction so that the gripping power of the projections are not affected by the warp of the flat circuit board.

The invention claimed is:

1. A flat circuit board electrical connector comprising:

a housing; and a terminal supported by said housing and having parallel upper and lower arms with projections between which a flat circuit board is inserted such that said flat circuit board is connected to said terminal, said terminal further including a linking section connecting middle portions of the parallel upper and lower arms, wherein at least one of said projections has a sharp tip for biting the flat circuit board, said sharp tip having a front edge and a rear edge, said front edge having a front angle smaller than 90 degrees with respect to the flat circuit board when the flat circuit board is inserted between the parallel upper and lower arms, said rear edge having a rear angle greater than 90 degrees with respect to the flat circuit board when the flat circuit board is inserted between the parallel upper and lower arms so that the sharp tip is pointed toward the linking section to securely hold the flat circuit board against a pulling out force.

2. The flat circuit board electrical connector according to claim 1, wherein said sharp tip is made by the front and rear edges, said front edge making an acute angle with said flat circuit board on a side of said rear edge.

3. The flat circuit board electrical connector according to claim 2, wherein at least one of said projections has a plurality of sharp tips.

4. The flat circuit board electrical connector according to claim 1, wherein at least one of said projections has a rounded tip while the other of said projections has the sharp tip.

5. The flat circuit board electrical connector according to claim 4, wherein at least one of said projections has a plurality of sharp tips.

6. The flat circuit board electrical connector according to claim 1, wherein said projections on said upper and lower arms are situated at the same positions as viewed from an insertion direction of said flat circuit board.

7. The flat circuit board electrical connector according to claim 6, wherein at least one of said projections has a plurality of sharp tips.

8. The flat circuit board electrical connector according to claim 1, wherein at least one of said projections has a plurality of sharp tips.

9. The flat circuit board electrical connector according to claim 1, wherein at least one of said projections has a plurality of sharp tips.

10. The flat circuit board electrical connector according to claim 1, further comprising a pressure member for applying a pressure to the parallel upper and lower arms.

11. The flat circuit board electrical connector according to claim 10, wherein said parallel lower arm includes a rotation supporting recess on a side opposite to the projection with the linking section inbetween for accommodating the pressure member.

12. The flat circuit board electrical connector according to claim 11, wherein said terminal further includes a protruded section adjacent to the rotation supporting recess on the parallel lower arm.

13. The flat circuit board electrical connector according to claim 10, wherein said parallel upper arm includes a downward recess on a side opposite to the projection with the linking section inbetween for accommodating the pressure member.

14. The flat circuit board electrical connector according to claim 10, wherein said pressure member includes a shaft portion for applying an upward pressure to the parallel upper arm.

15. The flat circuit board electrical connector according to claim 1, wherein said housing includes an engaging island, said terminal further including an engaging projection fixed to the engaging island.

16. A flat circuit board electrical connector comprising:

a flat circuit board having a base layer made of an insulative material, a circuit section disposed on a front side of the base layer, and a reinforcing plate disposed on a back side of the base layer;

a housing; and a terminal disposed in the housing and having a first arm and a second arm, said terminal further including a linking section connecting the first arm and the second arm, said first arm including a first projection with a sharp tip biting into the reinforcing plate and being pointed toward the linking section to securely hold the flat circuit board against a pulling out force, said second arm including a second projection electrically contacting with the circuit section.

17. The flat circuit board electrical connector according to claim 16, wherein said second projection has a rounded tip.

18. The flat circuit board electrical connector according to claim 16, further comprising a pressure member for applying a pressure to at least one of the first arm and the second arm.

19. The flat circuit board electrical connector according to claim 16, wherein said housing includes an engaging island, said terminal further including an engaging projection fixed to the engaging island.

* * * * *